United States Patent [19]

Zohler

[11] Patent Number: 5,010,643

[45] Date of Patent: Apr. 30, 1991

[54] HIGH PERFORMANCE HEAT TRANSFER TUBE FOR HEAT EXCHANGER

[75] Inventor: Steven R. Zohler, Manlius, N.Y.

[73] Assignee: Carrier Corporation, Syracuse, N.Y.

[21] Appl. No.: 541,715

[22] Filed: Jun. 21, 1990

Related U.S. Application Data

[62] Division of Ser. No. 244,294, Sep. 15, 1988, Pat. No. 4,938,282.

[51] Int. Cl.[5] ..... F28F 1/40

[52] U.S. Cl. ..... 29/890.048; 29/890.049; 165/133

[58] Field of Search ..... 29/890.048, 890.049; 165/133

[56] References Cited

U.S. PATENT DOCUMENTS 2,678,224 5/1954 Koolstra ..... 165/133

3,768,291 10/1973 Reiger ..... 165/133 X 4,658,892 4/1987 Shinohara et al. ..... 165/133

4,660,630 4/1987 Cunningham et al. ..... 165/133

*Primary Examiner*—Gerald A. Michalsky

*Attorney, Agent, or Firm*—Wall and Roehrig

[57] ABSTRACT

A high-performance heat transfer tube for an evaporator of an air-conditioning or refrigeration system is formed on a grooved mandrel that has a sufficient number of grooves, such as 60 to 90 for ⅝ inch tube, to produce a small-pitch internal rib enhancement. The small pitch ensures that the spaces or grooves between ribs are about two to five times the characteristic film thickness of the refrigerant liquid on the inside of the tube. This construction permits use of a thinner tube wall starting blank without loss of strength. Lands or unworked portions can be left at the tube ends to facilitate flaring into a tube sheet.

11 Claims, 1 Drawing Sheet

HIGH PERFORMANCE HEAT TRANSFER TUBE FOR HEAT EXCHANGER

This is a divisional of co-pending U.S. application Ser. No. 244,294 filed on Sept. 15, 1988, now U.S. Pat. No. 4,938,282, issued: July, 3, 1990.

BACKGROUND OF THE INVENTION

This invention relates to heat exchangers and is more particularly directed to heat exchangers in which a refrigerant fluid flows through the tubes and evaporates or condenses to accept heat from or give off heat to a coolant fluid in contact with the exterior of the tubes. The present invention is more specifically concerned with heat transfer tubes that have an internal rib enhancement, either with or without an external fin enhancement, and is also concerned with an improved method for making such tubing.

In the evaporator portion of certain refrigeration or air conditioning systems, a coolant fluid such as water passes through a chamber containing a number of tubes through which a refrigerant liquid is fed. The cooling fluid contacts the exterior of the tubes, and heats a refrigerant liquid in the tubes to evaporate it. The change of state of the refrigerant from liquid to vapor lowers the temperature of the coolant liquid. The internal configuration of the tubing is important in determining its overall heat transfer characteristics, and hence in determining the efficiency of the system. With evaporator tubing that has an internal rib enhancement, the evaporation takes place from a thin liquid film layer in contact with the internal surface, i.e., the sides and tips of the fins and the grooves between successive fins. An internal enhancement in the form of spiral or helical ribs causes swirling of the flowing refrigerant in the tube. This induces some turbulence, which breaks up laminar flow and thus also prevents any insulating barrier layer of vapor from forming on the interior surfaces of the tube.

Tubes that have an internal and/or an external enhancement are described, for example, in the commonly-assigned U.S. Pat. No. 4,425,696. That patent is directed to an evaporator tube configuration. Other finned tubes for heat transfer are described in U.S. Pat. Nos. 4,059,147 and 4,438,807.

In the tube finning machine employed in the production of this tubing, a grooved cylindrical mandrel within the tube produces the internal rib, while a tool gang of discs carried on a tool arbor produces a fin convolution on the exterior of the tubing. The force of the gang of discs on the metal tubing and against the mandrel causes the metal of the tubing to flow up between the discs to form the fins and down into the mandrels grooves to form the ribs. The external fins can be rolled over or smoothed by using a smooth disc.

Typically, a ⅝ inch heat exchanger tube has a starting blank wall thickness of 0.038 inch. The rib height is typically 0.020 to 0.030 inches, and there are about thirty internal ribs at a helix angle of thirty degrees.

It was desired to decrease the amount of materials required for the heat transfer tubes but without sacrifices of performance. In other words, it was desired to use thinner-walled blanks than the usual 0.038 inch-walled tubing, so that less copper would be required, or else a higher grade of copper could be employed without an increase in price. However, the standard mandrel-and-disc gang method of tube enhancement tended to weaken the tubes if the walls were much thinner than 0.038 inches. This is now believed to occur because the ribs were too high and the tube was worked too much. Thus the tendency to crack or split became unacceptably high.

Current techniques for tube enhancement involve ribbing and/or finning the entire tube, from one end to the other. When the tube is inserted into a tube sheet, it is typically secured by flaring or working the metal tube wall outwards into the circular collar of the tube sheet opening. After the metal wall has been once worked, i.e., by creating the internal enhancement, there is a tendency to flake or crack when the tube end is worked a second time. As a result, there is often an increased tendency to leak and a higher failure rate, if the tubes have an internal or external enhancement on its entire length.

OBJECTS AND SUMMARY OF THE INVENTION

Accordingly, it is an object of this invention to provide a heat transfer tube having superior efficiency characteristics when employed as an evaporator tube.

Another object of the present invention is to provide an efficient method for making high performance heat transfer tubes for use as evaporator tubes in a refrigeration or air conditioning system.

A more specific object is to produce a high-performance tube with internal enhancement, and which can be formed of a thinner-wall starting tube than is now possible, but without sacrifice of integrity.

Another object of this invention is to produce a tube which has an optimal amount of internal enhancement so that the liquid refrigerant is evaporated from the internal surfaces as efficiently as possible.

In accordance with an aspect of this invention, a heat transfer tube is produced with a plurality of helically extending interior ribs and with or without helically extending exterior fins. According to this invention, the interior ribs are disposed at sufficiently small pitch, and with a suitable helix angle, so that there is a spacing between successive ribs on the order of about two to five times the average thickness of the layer of refrigerant liquid film in contact with the internal surface of the tube. Here pitch means the interval or spacing of the ribs in the direction perpendicular to their length.

Typically, the refrigerant film thickness is less than 0.01 of a diameter, and the pitch of the internal enhancement is on the order of about 0.060 to 0.090 inches. The rib height is preferably about 0.010 to 0.013 inches, with an apex angle of about 35 degrees to 60 degrees. For each one inch of tube inside diameter, there are about 100 to 150 ribs. That is, for a 0.565 inch i.d. tube, there are about 60 to 90 ribs. The ribs can have a low helix angle, e.g., 18 degrees, but this can generally range from zero to thirty degrees.

With this construction a ⅝ inch tube starting blank of 0.025 to 0.030 inch wall thickness can be employed without sacrifice of integrity. This means the tube can be made at a lower material cost than previously, or else a higher grade metal can be used with no increase in materials cost.

To create the internally enhanced tube, a smooth-walled tubular workpiece is positioned over a cylindrical mandrel having a suitable number of grooves arranged to provide the internal ribs of the pitch, dimensionality, and helix angle indicated above. For example, for a ⅝ inch tube, the mandrel would have 60 to 90 starts or grooves at an 18 degree helix angle, to produce a pitch of 0.060 to 0.090 inches. For a ½" tube, the mandrel would have 60 to 75 starts, so that the resulting tube has 60 to 75 internal ribs. A gang of discs is rolled over the exterior surface of the tubular workpiece above the mandrel so that the metal of the workpiece flows into the mandrel grooves. This forms the internal ribs at the appropriate height and spacing to produce the optimal enhancement.

The space between successive ribs at the groove floor should, of course, be generally no closer than the preferred fin height so that the gaps do not become filled with liquid. On the other hand, the ribs should be as close together as possible, with the above limit in mind, to maximize the surface exposure on the tube interior. The above technique can be carried out on discrete tube lengths, commencing the internal enhancement a short distance in from one end and ceasing a short distance before the other end. This leaves an unworked portion in the vicinity of each tube end to facilitate seating the tube into tube sheets at each end of the tube.

The above and many other objects, features and advantages of this invention will be more fully understood from the ensuing description of a preferred embodiment, which should be read in conjunction with the accompanying Drawing.

DETAILED DESCRIPTION OF THE PREFERRED EMBODIMENT

An embodiment of the present invention as described below has been designed especially for use in an evaporator of a refrigeration or air conditioning system of the type in which a coolant liquid, which can be water, passes over the exterior of the heat transfer tubes, and in which a refrigerant is evaporated from liquid form to vapor form by contacting the internal surfaces of the tubes. Typically, there are a multiplicity of these heat transfer tubes mounted in parallel and connected so that several tubes form a fluid flow circuit and there are several of such parallel circuits provided to form a tube bundle. Usually, all of the tubes of the various fluid flow circuits are contained within a single casing that also contains a brine or another coolant liquid. A refrigerant is circulated through the fluid flow circuit, in the form of a liquid. The heat transfer characteristics of the evaporator are largely determined by the heat transfer characteristics of the individual tubes.

Figure 1:
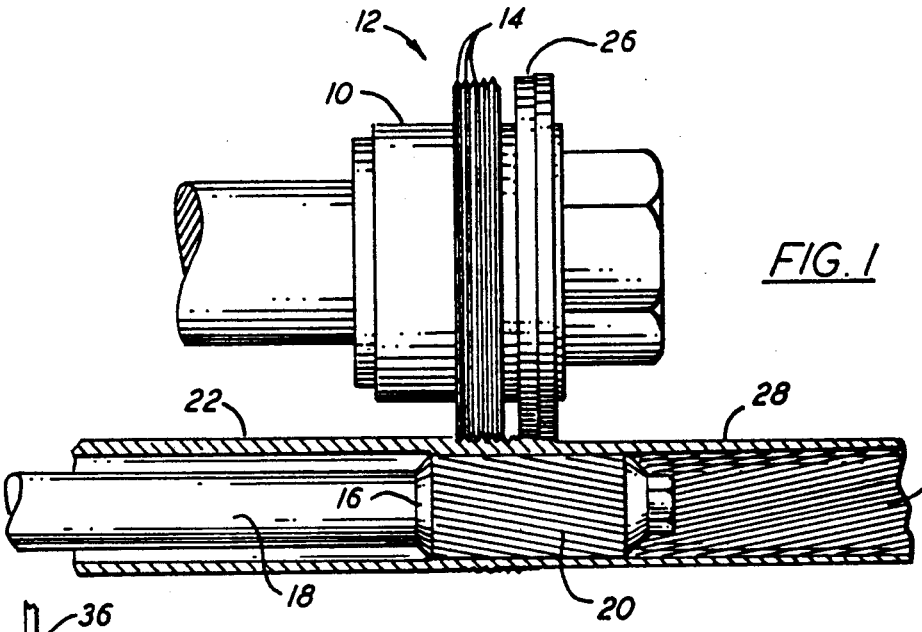
FIG. 1 is a schematic sectional view of an evaporator tube in the process of production, a grooved mandrel, and a tool arbor with tool gang for rolling a tube on the grooved mandrel to form the internally-ribbed heat transfer tube according to an embodiment of this invention.

Referring now to the Drawing, and initially to FIG. 1 thereof, a tube finning machine is shown in elevational cross section, and this machine comprises a tool arbor 10 with a tool gang 12 formed of a plurality of discs 14. At the axial position of the tool gang 12, there is disposed a mandrel 16 mounted on a mandrel shaft 18. The mandrel has a number of helical grooves 20 cut therein which correspond to the pattern of ribs that are to be formed in the tube. In this example, the mandrel 16 has seventy-two grooves 20, as opposed to the thirty grooves that are found on the mandrel used in conventional enhanced-tube manufacture. These seventy-two helical grooves 20 have a helix angle of about eighteen degrees, a depth of 0.010 inches, and are at a pitch or spacing of 0.060 to 0.090 inches.

A tubular workpiece 22 in this embodiment is a copper blank tube of 0.565 inch inside diameter, and wall thickness of generally 0.030 inch. The workpiece 22 is supported on the mandrel 16 beneath the tool gang 12, and the discs 14 on the arbor 10 are brought into contact with the tubular workpiece at a small angle relative to the longitudinal axis of the workpiece. This small amount of skew provides for a longitudinal driving of the workpiece 22 as the arbor 10 is rotated. The discs 14 displace the copper material of the tube wall, causing the material to flow downward into the grooves 20 to form an internal rib enhancement 24 and to flow up between the discs 14. A pair of rollers 26 behind the discs 14 smooth down any external convolution to produce a smoothened outer surface 28.

The optimal heat transfer characteristics, and the use of a thin-walled tubular workpiece 22 without risk to tube integrity, are achieved with the internal rib enhancement having the number of helical ribs, with pitch, height, and helix angle according to this invention.

Figure 2:
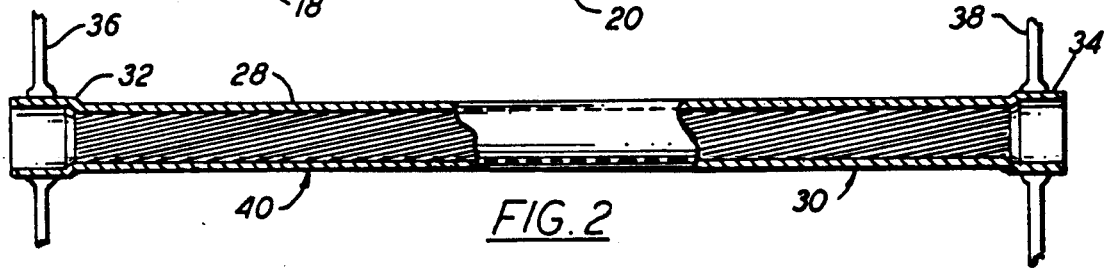
FIG. 2 shows a portion of a heat exchanger including tube sheets and a heat transfer tube of this invention seated therein.

As shown in FIG. 2, in a suitable heat exchanger heat transfer tube 30 has unworked first and second ends 32 and 34 which are fitted into respective tube sheets 36 and 38. This tube 30 is representative of the tubes of a tube bundle, and many other similar tubes would also be disposed in these tube sheets 36, 38. A principal portion 40 of this tube 30 has the internal enhancement as described above, but the ends 32,34 are left as lands, without the internal enhancement. The outside diameter of the ends, being the same as the original workpiece 22 is slightly greater than the outer diameter of the enhanced principal portion 40. Because of the technique here embodying the mandrel 20 and the disc gangs 14,26, it is possible to commence and terminate the grooving somewhat away from the ends so as to leave the ends 32,34 unworked. The ends 32,34 can be expanded outward i.e., flared, into the circular collars of the tube sheet without weakening. By way of contrast, flaring of previously worked tubing could lead to flaking or cracking, such as if the tube were enhanced from end to end. The unenhanced ends 32,34 also render the tube 30 somewhat easier to remove from the tube sheets 36,38 if replacement becomes necessary.

Figure 3:
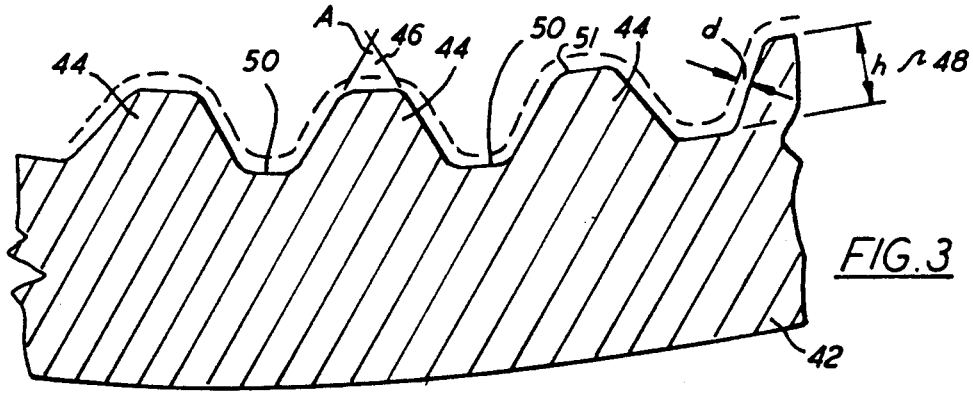
FIG. 3 is an enlarged sectional view of a portion of the tube wall of a heat transfer tube with rib enhancement according to one embodiment of this invention.

A portion of an enhanced tube 42 of this invention, as viewed along the axis, is shown in FIG. 3. Here the tube 42 is of nominal ⅝ inch outside diameter, at sixty "starts", that is, with sixty ribs 44 regularly spaced about the inside circumference. The ribs 44 have an apex angle 46 of sixty degrees and a height 48 (or corresponding mandrel groove depth) of 0.013 inches. A floor or groove bottom 50 of the groove between ribs meets the sides of the ribs 44 at a sharp corner, here at an angle of 120 degrees. These sharp corners hold the refrigerant liquid for better evaporation. As shown in ghost line, a refrigerant boundary liquid layer 51 has depth d on the order of 0.006 inches. The pitch of the ribs 42 corresponds to sixty ribs per circumference, and the space between ribs at the groove floor 50 is approximately 0.009 to 0.010 inches, i.e., slightly greater than about 1.5 the thickness of the liquid depth d. The fin height-to-inside-diameter ratio should be on the order of 0.015–0.030. The floor spacing or width of the floor 50 should also have a ratio to the inside diameter of the tube 42 on the order of 0.015 to 0.030.

Figure 4:
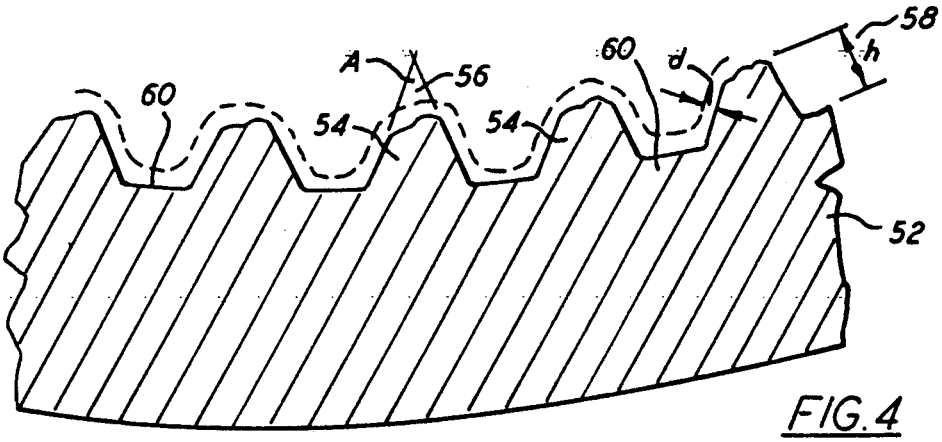
FIG. 4 is an enlarged sectional view of a portion of the tube wall of a heat transfer tube according to another embodiment of this invention.

Another embodiment of the heat transfer tube 52 of this invention is shown in FIG. 4, also of ⅝ inch nominal outside diameter. Here the tube 52 has seventy-two starts, or seventy-two ribs 54, with an apex angle 56 of forty-five degrees and a rib height 58 of about 0.010 inches. The refrigerant film depth d is on the order of 0.006 inches, as above. The span between ribs 54 at the floor 60 of the groove is about 0.011 inches.

In either of these embodiments, there is about a fourteen percent reduction in material due to a reduction in wall thickness. The tubes 42,52 can be made on blank workpieces 22 with an 0.033 inch wall thickness. By way of comparison, when using a conventional mandrel (i.e., fifteen to thirty starts) the workpieces that are typically employed have a wall thickness of 0.038 inches. If the walls of conventional tubes were thinner than about 0.038 inches, the leak or failure rate would become unacceptably high. The use of a thinner-wall starting blank, under this invention, also permits use of a higher quality material at the same or lower cost per running foot as previously.

The sharp apex angles 46,56 of the ribs increase the effective area of the tube interior, thus yielding still greater efficiency.

In the embodiments described above, the ribs have a helix angle of eighteen degrees, selected for ease of manufacture. However, the helix angle could be twenty to twenty-five degrees, or up to thirty degrees, or could be dropped to slightly greater than zero.

Instead of the smooth outer surface 28, the heat transfer tube could be provided with an external fin enhancement whose pitch and height would be determined according to the nature of the fluid in contact with the outer surface.

In the FIG. 4 embodiment, the tips or upper ends of the ribs 54 are shown as being somewhat irregular. This is simply to illustrate that ideal, regularly shaped tips are not critical to evaporator tubes, and geometrical variations and lack of pointiness of the tips do not appear to have adverse effects on the tube efficiency. Nevertheless, in a condenser environment, there may be an advantage to maintaining sharply pointed tips.

While the invention has been described hereinabove with reference to preferred embodiments, it should be understood that the invention is not limited to those embodiments. Rather, many modifications and variations will present themselves to those of skill in the art without departing from the scope and spirit of this invention, as defined in the appended claims.

What is claimed is:

1. A method of making an internally ribbed heat transfer tube from a smooth-walled tubular metal workpiece by positioning the tubular workpiece on a generally cylindrical mandrel that has a plurality of helical grooves formed on its surface, and rolling a gang of discs over the exterior surface of the tubular workpiece above the mandrel so that the metal of the workpiece flows into the mandrel grooves to form said internal ribs at a given pitch, with said ribs having a predetermined height; wherein the improvement comprises forming said ribs so that the pitch thereof is on the order of 0.060 to 0.090 inches, and said ribs are formed with said predetermined height 0.015 to 0.030 times the inside diameter.

2. The method of claim 1 wherein said forming the ribs includes establishing a rib helix angle greater than zero and up to thirty degrees.

3. The method of claim 2 wherein said rib helix angle is substantially eighteen degrees.

4. A method according to claim 1 wherein said tube is a straight tube of finite length defined by first and second ends, and said forming the ribs includes leaving an unworked, ribless portion in the vicinity of each of said first and second ends.

5. A method according to claim 1 wherein the floor spacing between successive ribs is on the order of about 1.5 times a characteristic film thickness of a working refrigerant.

6. A method of making an internally ribbed heat transfer tube from a smooth-walled tubular metal workpiece by positioning the tubular workpiece on a generally cylindrical mandrel that has a plurality of helical grooves formed on its surface, and rolling a gang of discs over the exterior surface of the tubular workpiece above the mandrel sos that the metal of the workpiece flows into the mandrel grooves to form said internal ribs at a regular spacing; wherein the improvement comprises forming said ribs such that for each one inch of outside diameter of the tube there are about 100 to 150 of said ribs, and with a floor spacing between successive ribs on the order of about 0.010 inches.

7. A method according to claim 6 wherein said forming said ribs includes imparting to the ribs an apex angle of about forty-five degrees to sixty degrees.

8. A method according to claim 6 wherein said forming the ribs includes establishing a rib helix angle greater than zero and up to about thirty degrees.

9. A method according to claim 6 wherein said tube is a straight tube of finite length defined by first and second ends, and said forming the ribs includes leaving an unworked, ribless portion in the vicinity of each of said first and second ends.

10. A method according to claim 6 wherein said floor spacing includes a floor and said ribs are formed with side walls that rise from said floor at a sharp corner with an angle of about 120 degrees.

11. A method according to claim 6 wherein a working refrigerant fluid with which the tube is to be employed has a characteristic liquid film thickness and said floor spacing between successive ribs is on the order of about 1.5 times the characteristic liquid film thickness.

* * * * *